US005472647A

United States Patent [19]

Blau et al.

[11] Patent Number: 5,472,647

[45] Date of Patent: Dec. 5, 1995

[54] METHOD FOR PREPARING ANHYDROUS TETRAZOLE GAS GENERANT COMPOSITIONS

[75] Inventors: Reed J. Blau, Richmond; Gary K. Lund, Ogden, both of Utah

[73] Assignee: Thiokol Corporation

[21] Appl. No.: 178,572

[22] Filed: Jan. 7, 1994

Related U.S. Application Data

[63] Continuation-in-part of Ser. No. 162,596, Dec. 3, 1993, which is a continuation-in-part of Ser. No. 101,396, Aug. 2, 1993.

[51] Int. Cl.[6] ..... C06B 21/00

[52] U.S. Cl. ..... 264/3.1; 149/19.92; 149/109.6; 264/34

[58] Field of Search ..... 264/3.1, 3.4; 149/109.6, 149/19.92

[56] References Cited

U.S. PATENT DOCUMENTS

| | | | |
|---|---|---|---|
| 2,981,616 | 4/1961 | Boyer | 52/5 |
| 3,122,462 | 2/1964 | Kaufman et al. | 149/35 |
| 3,468,730 | 9/1969 | Gawlick et al. | 149/61 |
| 3,674,059 | 7/1972 | Stephenson | 141/4 |
| 3,719,604 | 3/1973 | Prior et al. | 252/186 |
| 3,739,574 | 6/1973 | Godfrey | 60/39.03 |
| 3,773,351 | 11/1973 | Catanzarite | 280/150 AB |
| 3,773,352 | 11/1973 | Radke | 280/150 AB |
| 3,773,947 | 11/1973 | Boyars et al. | 423/351 |
| 3,775,182 | 11/1973 | Marshall | 252/188.3 |
| 3,778,084 | 12/1973 | Sutherland et al. | 280/150 |
| 3,779,823 | 12/1973 | Price et al. | 149/19 |
| 3,785,049 | 1/1974 | Timmerman | 60/205 |
| 3,787,074 | 1/1974 | Lewis et al. | 280/150 AB |
| 3,791,302 | 2/1974 | McLeod | 102/70.2 |
| 3,806,461 | 4/1974 | Hendrickson et al. | 252/188.3 R |
| 3,833,029 | 9/1974 | Munn | 141/4 |
| 3,833,432 | 9/1974 | Moy et al. | 149/19.3 |
| 3,862,866 | 1/1975 | Timmerman et al. | 149/21 |
| 3,868,124 | 2/1975 | Johnson | 280/150 AB |
| 3,880,447 | 4/1975 | Thorn et al. | 280/150 AB |
| 3,880,595 | 4/1975 | Timmerman | 23/281 |
| 3,883,373 | 5/1975 | Sidebottom | 149/6 |
| 3,895,098 | 7/1975 | Pietz | 423/351 |
| 3,897,235 | 7/1975 | Hamilton et al. | 149/41 |
| 3,898,112 | 8/1975 | Strecker et al. | 149/19.9 |
| 3,902,934 | 9/1975 | Timmerman | 149/83 |
| 3,909,322 | 9/1975 | Chang et al. | 149/19.4 |
| 3,912,458 | 10/1975 | Fukuma et al. | 23/281 |
| 3,912,561 | 10/1975 | Doin et al. | 149/35 |
| 3,912,562 | 10/1975 | Garner | 149/41 |
| 3,931,040 | 1/1976 | Breazcale | 252/188.3 R |
| 3,933,543 | 1/1976 | Madden | 149/21 |
| 3,934,984 | 1/1976 | Marlow et al. | 23/281 |
| 3,936,330 | 2/1976 | Dergazarian et al. | 149/35 |
| 3,940,298 | 2/1976 | Beckert et al. | 149/19.1 |
| 3,947,300 | 3/1976 | Passauer et al. | 149/35 |
| 3,964,255 | 6/1976 | Catanzarite | 60/205 |
| 3,971,729 | 7/1976 | Timmerman | 252/187 R |
| 3,996,079 | 12/1976 | Divalentin | 149/35 |
| 4,021,275 | 5/1977 | Kishi et al. | 149/35 |
| 4,062,708 | 12/1977 | Goetz | 149/35 |
| 4,114,591 | 9/1978 | Nakagawa | 126/263 |
| 4,128,996 | 12/1978 | Garner et al. | 60/205 |
| 4,142,029 | 2/1979 | Illy | 521/95 |
| 4,152,891 | 5/1979 | Garner | 60/205 |
| 4,157,648 | 6/1979 | Brennan et al. | 60/205 |
| 4,179,327 | 12/1979 | Seldner | 156/667 |
| 4,200,615 | 4/1980 | Hamilton et al. | 422/166 |
| 4,203,786 | 5/1980 | Garner | 149/19.91 |
| 4,203,787 | 5/1980 | Kirchoff et al. | 149/35 |
| 4,214,438 | 7/1980 | Hamilton et al. | 60/205 |
| 4,238,253 | 12/1980 | Garner | 149/19 |
| 4,244,758 | 1/1981 | Garner et al. | 149/7 |
| 4,246,051 | 1/1981 | Garner et al. | 149/7 |
| 4,298,412 | 11/1981 | Biddle et al. | 149/19.5 |
| 4,306,499 | 12/1981 | Holmes | 102/202.4 |
| 4,339,288 | 7/1982 | Camp | 149/8 |
| 4,369,079 | 1/1983 | Shaw | 149/2 |
| 4,370,181 | 1/1983 | Lundstrom et al. | 149/2 |
| 4,370,930 | 2/1983 | Strasser et al. | 102/530 |
| 4,376,002 | 3/1983 | Utracki | 149/35 |
| 4,390,380 | 6/1983 | Camp | 149/8 |
| 4,407,119 | 10/1983 | Biddle et al. | 60/219 |
| 4,414,902 | 11/1983 | Strasser et al. | 102/531 |
| 4,424,086 | 1/1984 | Christopher | 149/19.3 |
| 4,444,606 | 4/1984 | Bertrand et al. | 149/2 |
| 4,450,768 | 5/1984 | Bell | 102/307 |
| 4,533,416 | 8/1985 | Poole | 149/35 |
| 4,547,235 | 10/1985 | Schneiter et al. | 149/35 |

(List continued on next page.)

FOREIGN PATENT DOCUMENTS

0519485A1 12/1992 European Pat. Off. ..... C06D 5/06

OTHER PUBLICATIONS

William P. Norris and Ronald A. Henry, "Cyanoguanyl Azide Chemistry", pp. 650–660, Mar. 1964.

R. Stollé, "5–Aminotetrazole", *10—Organic Chemistry,* vol. 23, p. 4471, 1929.

R. Stollé, "Zur Kenntnis des Amino–5–tetrazols", Jarhrg. 62, pp. 1118–1127, 1929 (chemical abstracts English translation is enclosed as reference A16).

*Primary Examiner*—Edward A. Miller

*Attorney, Agent, or Firm*—Madson & Metcalf; Ronald L. Lyons

[57] ABSTRACT

A present method involves preparing an anhydrous gas generant by forming a quantity of granulated anhydrous gas generating material into a shaped charge wherein the gas generating material is an oxidizer and at least one fuel selected from the group consisting of tetrazoles. More particularly, a preferred method involves preparing an anhydrous gas generating composition by preparing a slurry of gas generating material which comprises oxidizer particles larger than 1 micron and fuel particles larger than 1 micron wherein the oxidizer is selected from the group consisting of a metal peroxide, an inorganic nitrate, an inorganic nitrite, a metal oxide, a metal hydroxide, an inorganic chlorate, an inorganic perchlorate, or a mixture thereof, and the fuel is selected from the group consisting of tetrazoles; granulating the slurry to obtain granules of a selected weight average particle size; drying the granules to an anhydrous condition; and pelletizing the anhydrous granules.

29 Claims, No Drawings

U.S. PATENT DOCUMENTS

| | | | |
|---|---|---|---|
| 4,547,342 | 10/1985 | Adams et al. | 422/166 |
| 4,578,247 | 3/1986 | Bolieau | 422/165 |
| 4,590,860 | 5/1986 | Kromrey | 102/289 |
| 4,604,151 | 8/1986 | Knowlton et al. | 149/35 |
| 4,608,102 | 8/1986 | Krampen et al. | 149/92 |
| 4,664,033 | 5/1987 | Burkdoll et al. | 102/275.2 |
| 4,696,705 | 9/1987 | Hamilton | 149/21 |
| 4,698,107 | 10/1987 | Goetz et al. | 149/7 |
| 4,699,400 | 10/1987 | Adams et al. | 280/731 |
| 4,734,141 | 3/1988 | Cartwright et al. | 149/35 |
| 4,758,287 | 7/1988 | Pietz | 149/2 |
| 4,798,142 | 1/1989 | Canterberry et al. | 102/290 |
| 4,806,180 | 2/1989 | Goetz et al. | 149/5 |
| 4,833,996 | 5/1989 | Hayashi et al. | 102/530 |
| 4,834,817 | 5/1989 | Zeuner et al. | 149/35 |
| 4,834,818 | 5/1989 | Kazumi et al. | 149/35 |
| 4,865,667 | 9/1989 | Zeuner et al. | 149/22 |
| 4,890,860 | 1/1990 | Schneiter | 280/741 |
| 4,909,549 | 3/1990 | Poole et al. | 280/738 |
| 4,919,897 | 4/1990 | Bender et al. | 422/165 |
| 4,929,290 | 5/1990 | Cartwright | 149/35 |
| 4,931,111 | 6/1990 | Poole et al. | 149/35 |
| 4,931,112 | 6/1990 | Wardle et al. | 149/88 |
| 4,948,439 | 8/1990 | Poole et al. | 149/46 |
| 4,950,458 | 8/1990 | Cunningham | 422/164 |
| 4,959,011 | 9/1990 | Nilsson | 431/263 |
| 4,981,534 | 1/1991 | Scheffe | 149/19.91 |
| 4,982,664 | 1/1991 | Norton | 102/272 |
| 4,998,751 | 3/1991 | Paxton et al. | 280/741 |
| 5,003,887 | 4/1991 | Unterforsthuber et al. | 102/531 |
| 5,004,586 | 4/1991 | Hayashi et al. | 422/164 |
| 5,005,486 | 4/1991 | Lenzen | 102/531 |
| 5,015,309 | 5/1991 | Wardle et al. . | |
| 5,015,311 | 5/1991 | Ramaswamy | 149/42 |
| 5,019,192 | 5/1991 | Ramaswamy | 149/42 |
| 5,019,220 | 5/1991 | Taylor et al. | 264/3.4 |
| 5,022,674 | 6/1991 | Frantom et al. | 280/741 |
| 5,024,160 | 6/1991 | Canterberry et al. | 102/323 |
| 5,031,932 | 7/1991 | Frantom et al. | 280/741 |
| 5,033,390 | 7/1991 | Minert et al. | 102/530 |
| 5,034,070 | 7/1991 | Goetz et al. | 149/109.6 |
| 5,035,757 | 7/1991 | Poole | 149/46 |
| 5,043,030 | 8/1991 | Ramaswany | 149/16 |
| 5,046,429 | 9/1991 | Swann et al. | 102/530 |
| 5,052,817 | 11/1991 | Bement et al. | 374/8 |
| 5,053,086 | 11/1991 | Henry et al. | 149/19.4 |
| 5,062,365 | 11/1991 | Canterberry | 102/322 |
| 5,062,367 | 11/1991 | Hayashi et al. | 102/530 |
| 5,073,273 | 12/1991 | Gupta et al. | 210/760 |
| 5,074,940 | 12/1991 | Ochi et al. | 149/35 |
| 5,084,118 | 1/1992 | Poole | 149/22 |
| 5,089,069 | 2/1992 | Ramaswamy et al. | 149/21 |
| 5,094,475 | 3/1992 | Olsson et al. | 280/741 |
| 5,098,597 | 3/1992 | Rothgery et al. | 252/182.34 |
| 5,100,174 | 3/1992 | Jasken et al. | 280/741 |
| 5,104,466 | 4/1992 | Allard et al. | 149/21 |
| 5,125,684 | 6/1992 | Cartwright | 267/3.3 |
| 5,139,588 | 8/1992 | Poole | 149/61 |
| 5,197,758 | 3/1993 | Lund et al. | 280/741 |
| 5,198,046 | 3/1993 | Bucering et al. | 149/61 |
| 5,212,343 | 5/1993 | Brupbacher et al. | 102/323 |

METHOD FOR PREPARING ANHYDROUS TETRAZOLE GAS GENERANT COMPOSITIONS

RELATED APPLICATIONS

The present application is a continuation-in-part of copending application Ser. No. 08/162,596, filed Dec. 3, 1993, titled Anhydrous Tetrazole Gas Generant Compositions And Methods of Preparation, which is a continuation-in-part of copending application Ser. No. 08/101,396 filed Aug. 2, 1993, titled Bitetrazoleamine Gas Generant Compositions. The complete disclosures of applications Ser. Nos. 08/162,596 and 08/101,396 are incorporated by reference.

FIELD OF THE INVENTION

The present invention relates to a method for making novel gas generating compositions which are useful for inflating automobile air bags and similar devices. More particularly, the present invention relates to a method for making gas generating pyrotechnic compositions based on anhydrous tetrazole compounds as a primary fuel.

BACKGROUND OF INVENTION

The art has been seeking an acceptable non-azide gas generant which has the desired combination of properties for being a drop-in replacement for the conventional sodium azide-fueled gas generating composition used in air bags in passenger vehicles.

In addition to properties, such as acceptable rate of gas generation and reduced or no toxic combustion byproducts, a proposed replacement for the conventional sodium azide-fueled gas generant must be capable of being manufactured and formed into a pill, pellet, extruded cylinder, or other desired shape charge. The desired shape, typically a pellet, must be capable of retaining structural integrity.

Various methods have heretofore been proposed for processing gas generant compositions to obtain shaped charges such as pellets. However, different gas generant compositions behave differently during the pelletizing process, and particular process conditions suitable for fabricating objects composed of one gas generant are not necessarily applicable to processing or fabricating objects, such as pellets, composed of a different gas generant composition.

We have proposed a non-azide-fueled gas generant composition, and have made extensive studies on its preparation and fabrication. We have developed certain techniques for fabricating the non-azide composition into pellets or other desired forms. In the course of that work, we observed, however, that attempts to pelletize directly anhydrous gas generants based on a fuel of the tetrazole class, such as aminotetrazole or bistetrazoleamine, produces pellets that crumble and lose their pellet shape within 24 hours at Rh 45% at 25° C.

As a result of such efforts, we have determined that it would, therefore, be a significant advancement in the art to provide a method for preparing shaped charges, such as pellets, comprised of non-azide tetrazole-fueled compositions directly from an anhydrous material composed of that composition wherein the shaped charges so produced retain their structural integrity after exposure at a Rh 45% at 25° C. It would be an advancement in the art to provide shaped forms, such as pellets or the like, which are capable of being combusted to generate large quantities of gas that would overcome the problems identified in the existing art. It would be a further advancement to prepare shaped charges, such as a pellets, comprised of non-azide tetrazole-fueled gas generating compositions which are based on substantially nontoxic starting materials and which produce substantially nontoxic reaction products. It would be, in particular, an advancement in the art to produce combustion gases which primarily consist of nitrogen, with lesser amounts of carbon dioxide and water vapor so as not to exceed allowable occupant exposure standards for carbon dioxide and carbon monoxide. It would be another advancement in the art to prepare shaped charges, such as pellets, comprised of gas generating compositions which combust to produce limited particulate debris and limited undesirable gaseous products. It would also be an advancement in the art to prepare pellets comprised of gas generating compositions which combust and form a readily filterable solid slag upon reaction.

Methods for making shaped charges, such as pellets, directly from anhydrous non-azide tetrazole-fueled gas generant compositions are disclosed and claimed herein.

SUMMARY AND OBJECTS OF THE INVENTION

The method according to the present invention overcomes or minimizes processing difficulties encountered in manufacturing charges, such as pellets, from anhydrous tetrazole-fueled gas generant compositions.

A method according to the present invention involves obtaining a desired quantity of gas generating material comprising particles of at least one oxidizer and particles of at least one tetrazole as the fuel; preparing a wet mixture containing the gas generating material; drying the material to an anhydrous condition having a specified weight average particle size; and pressing the anhydrous material into pellets. The gas generating material is preferably pelletized from anhydrous granules obtained from a wet mixture which can be agglomerated, such as a granulatable slurry or paste. The particle sizes of the oxidizer and the tetrazole fuel can also be controlled within pre-selected number average particle size ranges when preparing the slurry or paste.

This development overcomes a problem encountered in our prior efforts to pelletize anhydrous tetrazole-fueled gas generant compositions. In our prior efforts, pellets produced from anhydrous tetrazole-fueled gas generant compositions were generally observed to crumble and powder, particularly when exposed to a humid environment, within 24 hours. Pellets prepared by our present method are, by comparison, robust and can retain their structural integrity when exposed to humid environments.

DETAILED DESCRIPTION OF THE INVENTION

The present method involves preparing charges, such as pellets, from an anhydrous gas generating composition by forming a quantity of granulated anhydrous gas generating material into a charge wherein the gas generating material comprises an oxidizer and a non-azide fuel which is of the tetrazole class. More particularly, a preferred method involves preparing pellets from the anhydrous gas generating composition by slurrying a quantity of gas generating material which comprises oxidizer particles having a number average particle size greater than 1 micron and fuel particles having particles sizes greater than 1 micron wherein the fuel is selected from the group consisting of tetrazoles; if necessary, rendering the slurry capable of being made particulate, such as granulatable, such as by drying, for instance, the slurried material; rendering the slurry into particles, such as granules, having sizes of at least about 100 mesh; drying the granulated material to an anhydrous condition; and pelletizing the anhydrous granulated material, i.e., shaping the anhydrous granules into pellets.

The slurry can be obtained by blending effective amounts of a fuel from the tetrazole class, and an oxidizer in sufficient amounts of a medium, such as water. It is not necessary nor particularly desirable that the fuel and/or oxidizer be rendered anhydrous prior to mixing. The slurry can be prepared in one step or in a series of steps. The number average particle size of the tetrazole fuel used in preparing the slurry can be in the range of from about 1 micron to about 100 microns, although a range of about 10 microns to about 40 microns is presently preferred. The number average particle size of the oxidizer, such as CuO, used in preparing the slurry can be in the range of from about 1 micron to about 20 microns, although a range of about 3 microns to about 10 microns is presently preferred, such as a number average particle size greater than about 5 microns. Sub-micron sized oxidizer particles are not presently preferred because the pellets ultimately produced have been observed to crumble and lose pellet integrity within 24 hours at Rh 45%.

By preference, the medium is water. Other solvents in which the tetrazole exhibits some solubility may be used such as volatile organic solvents such as, for instance, alcohols such as methanol, ethanol, and propanol, and ketones such as acetone or methylethyl ketone.

In a preferred embodiment, the amount of water is generally selected to be sufficient to obtain a granulatable slurry, or a compactable powder which can be granulated or rendered granulatable. In general, it is not desired to dissolve all of the fuel or oxidizer. Consequently, although an excess of water can be used, its use does not lead to any particular advantages. Therefore, the slurry can comprise less than about 50% by weight water with the gas generating ingredients comprising the remainder. For instance, the slurry can comprise about 3% to about 40% by weight water and from about 60% to about 97% by weight of the gas generating composition, although it is preferred to use at least about 20% by weight and up to about 40% by weight water. Predictability of ballistic performance may be adversely affected by straying substantially beyond the preferred water concentration.

In a multi-step preparation, a selected amount of water and the gas generating compositions can be mixed to obtain a damp compactable powder. The damp powder can, if desired, be mixed with additional water to obtain a slurry material having a paste-like consistency.

As evident, obtaining a pulverulent anhydrous gas generant composition before preparing the slurry is neither necessary, nor particularly advantageous in the present process. The particular species of a hydrated tetrazole fuel and the particular oxidizer selected should, however, have an average number particle size as indicated elsewhere herein when preparing the slurry. The fuel species and oxidizer can be added at once, alternatively, or in portions to the slurry medium provided that the materials are in intimate contact, and sufficient compositional uniformity of the slurry is achieved.

In a preferred embodiment the water has a pH in the range of about 5 to about 11 prior to being combined with the fuel particles and oxidizer particles. After the tetrazole fuel, such as BTA, is added the pH decreases to about pH≦3. A pH substantially outside the preferred ranges is undesired owing to dissolution of the oxidizer and to avoid complex formation. Poor pH control can be evident in even the final anhydrous product.

It is preferable to avoid allowing the slurry or suspension of gas generant particles to remain wet, in water or other solvent, for an extended period of time. Complexes of the tetrazole may form, or complexes of the tetrazole and oxidizer may form. For instance, a BTA-Cu complex is dark green, and a Cu-5AT complex is green.

Uncontrolled complex formation during the slurrying step may result in less predictable ballistic properties of the final anhydrous product.

The slurry can be dried, if necessary, to obtain a partially dried granulatable material, although it is not desired to render the material anhydrous before granulation.

Next, the material is rendered into particulate form having a weight average particle size from about 100 mesh and to about 14 mesh. Crumbs, prills, extruded cylinders, disks, pills, or granules of the appropriate size distribution can be used. General techniques adaptable to agglomerating, i.e., increasing particle size, include, granulating, extruding, bricketting, pelleting, tableting, and spray drying, and are described in *Perry's Chemical Engineers's Handbook,* Section 16 (3rd. Ed. 1950), the complete disclosure of which is incorporated herein by reference, provided that the desired particle sizes are obtained. For instance, while the agglomeratable material is still wet or moist, the material can be wet-meshed or wet-extruded to obtain granules. The granules can have particle sizes in the range of, for instance, from about 14 to about 100 mesh. It is presently preferred that the particles, such granules, have a weight average particle size in the range of from about 14 to about 30 mesh.

The material which has been rendered into particulate form is dried to remove solvent to achieve an anhydrous state. In general, with respect to water, the essential absence of free water, including water measured as hydrate or unbound but occluded or adventitious moisture, is indicative of the anhydrous state. By preference the material is rendered water-free. In this regard, it is known that a dried tetrazole fueled composition consisting of 22.9% BTA monohydrate and 77.1% CuO can still lose about 3 to 4 wt % when further dried, and that the additional weight loss reflects removal of principally hydrate and small amounts of unbound but occluded or adventitious moisture. Hence, the drying contemplated herein involves removal of the water of hydration and any occluded or unbound or adventitious water. The precise temperature and length of time of drying are not critical to the practice of the invention, as long as anhydrous granules are obtained. For instance, drying the agglomeratable material to constant weight at less than 75° C. generally less than 45° C. followed by further drying, such as at a temperature of from about 110° C. to about 140° C., for a sufficient duration of time to remove hydrate, occluded or unbound, and adventitious moisture. The just mentioned sufficient time will be a function of the temperature and pressure conditions prevailing during the drying step. For example, in a drying oven at 1 bar, 12 to 24 hours can be sufficient when the temperature is in the range of about 110° C. to about 120° C. It is presently preferred that the materials not be subjected to temperatures in excess of about 150° C. for extended periods of time.

Adequate achievement of the anhydrous state as specified or contemplated herein can be readily determined by subsequently exposing an anhydrous composition to a relative humidity of at least 45% for a minimum of 24 hours. A gain in weight of the composition resulting from this treatment to within about 0.5% of the theoretical amount due to fuel hydration is indicative of sufficient dehydration of the composition.

When an organic solvent other than water is used, anhydrous means removal of the solvent residue as well as water of hydration and any occluded or unbound or adventitious water.

Other drying techniques can be used such as freeze drying, vacuum drying, convection drying, dielectric or high frequency drying, spray drying, and, for instance, fluidized bed drying as described in *Perry's Chemical Engineers's Handbook*, Section 13 (3rd. Ed. 1950), the complete disclosure of which is incorporated herein by reference. The slurry can, if desired, be converted directly to the desired sized and anhydrous particles, such as granules, by, for instance, extruding the slurry in a heated and vented extruder or spray drying the slurry. Other means for converting the slurry directly to the desired sized particles, such as granules, can also be used.

Solid charges are prepared from the anhydrous material. In a presently preferred embodiment, the anhydrous granulated material is typically pelletized, i.e. pressed into pellet form to meet the specific requirements for use in automotive safety restraint systems.

The solid charges produced according to the method of the present invention have at least one compound of the tetrazole class (sometimes referred to herein as simply "tetrazole") as a fuel and at least one appropriate oxidizer. In particular, the pellets of the gas generant composition are based on anhydrous tetrazoles, such as 5-aminotetrazole and bitetrazoleamines, or a salt or a complex thereof or mixtures thereof. One presently preferred bitetrazoleamine is bis-(1(2)H-tetrazol-5-yl)-amine (hereinafter sometimes referred to as "BTA"). The shaped charges are useful in supplemental restraint systems, such as automobile air bags.

One group of suitable tetrazoles for use in the present invention are bitetrazole-amines such as those having the following structure:

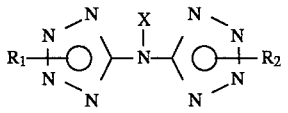

wherein X, $R_1$ and $R_2$, each independently, represent hydrogen, methyl, ethyl, cyano, nitro, amino, tetrazolyl, a metal from Group Ia, Ib, IIa, IIb, IIIa, IVb, VIb, VIIb or VIII of the Periodic Table (Merck Index (11th Edition 1989)), or a nonmetallic cation of a high nitrogen-content base.

Other tetrazoles include tetrazole, 5-aminotetrazole (hereinafter sometimes referred to as "5AT"), bitetrazole, the n-substituted derivatives of aminotetrazole such as nitro, cyano, guanyl, and the like, and c-substituted tetrazoles such as cyano, nitro, hydrazino, and the like.

Salts or complexes of any of these tetrazoles including those of transition metals such as copper, cobalt, iron, titanium, and zinc; alkali metals such as potassium and sodium; alkaline earth metals such as strontium, magnesium, and calcium; boron; aluminum; and nonmetallic cations such as ammonium, hydroxylammonium, hydrazinium, guanidinium, aminoguanidinium, diaminoguanidinium, triaminoguanidinium, orbiguanidinium can also serve as the fuel in the pellets produced in accordance with the present invention.

An appropriate oxidizer is included in the composition. Inorganic oxidizing agents are preferred because they produce a lower flame temperature and an improved filterable slag. Such oxidizers include metal oxides and metal hydroxides, such as transition metal oxides and transition metal hydroxides. Other oxidizers include a metal nitrate such as, for instance, an alkali metal nitrate or strontium nitrate, a metal nitrite such as, for instance, an alkali metal nitrite or a nitrite of, for instance, strontium, cobalt or chromium, a metal chlorate such as, for instance, $KClO_3$, a metal perchlorate such as, for instance, $NaClO_4$, $KClO_4$ and the like, a metal peroxide such as, for instance, an alkaline earth peroxide, ammonium nitrate, ammonium perchlorate and the like. The use of metal oxides or hydroxides as oxidizers is particularly useful and such materials include for instance, the oxides and hydroxides of copper, cobalt, manganese, tungsten, bismuth, molybdenum, and iron, such as CuO, $Co_2O_3$, $Fe_2O_3$, $MoO_3$, $Bi_2MoO_6$, $Bi_2O_3$, and $Cu(OH)_2$. The oxide and hydroxide oxidizing agents mentioned above can, if desired, be combined with other conventional oxidizers such as $Sr(NO_3)_2$, $NH_4ClO_4$, and $KNO_3$, for a particular application, such as, for instance, to provide increased flame temperature or to modify the gas product yields.

The tetrazole fuel is combined, in a fuel-effective amount, with an appropriate oxidizing agent to obtain a gas generating composition. In a typical formulation, the tetrazole fuel comprises from about 10 to about 50 weight percent of the composition and the oxidizer comprises from about 50 to about 90 weight percent thereof. More particularly, a composition can comprise from about 15 to about 35 weight percent fuel and from about 65 to about 85 weight percent oxidizer.

Additives conventionally used in gas generating compositions, propellants, and explosives, such as binders, burn rate modifiers, slag formers, release agents, and additives which effectively remove $NO_x$ can, if desired, be included in the anhydrous compositions obtained in accordance with the present invention. For instance, the additives can be introduced when the slurry is being prepared or at another step in the present process. Typical binders include lactose, boric acid, silicates including magnesium silicate, polypropylene carbonate, polyethylene glycol, and other conventional polymeric binders. The binder can be added at any convenient stage of the process. Typical burn rate modifiers include $Fe_2O_3$, $K_2B_{12}H_{12}$, $Bi_2MoO_6$, and graphite carbon fibers. A number of slag forming agents are known and include, for example, clays, talcs, silicon oxides, alkaline earth oxides, hydroxides, oxalates, of which magnesium carbonate, and magnesium hydroxide are exemplary. A number of additives and/or agents are also known to reduce or eliminate the oxides of nitrogen from the combustion products of a gas generant composition, including alkali metal salts and complexes of tetrazoles, aminotetrazoles, triazoles and related nitrogen heterocycles of which potassium aminotetrazole, sodium carbonate and potassium carbonate are exemplary. The composition can also include materials which facilitate the release of the composition from a mold such as graphite, molybdenum sulfide, calcium stearate, or boron nitride.

Tetrazoles are commercially available or can be readily synthesized. A synthesis of BTA is disclosed in copending application serial number 08/101,396, referred to above.

Substituted tetrazole derivatives, such as substituted 5AT and BTA derivatives, can be prepared from suitable starting materials, such as substituted tetrazoles, according to techniques available to those skilled in the art. For instance, derivatives containing lower alkyl, such as methyl or ethyl, cyano, or tetrazolyl can be prepared by adapting the procedures described in *Journal of Organic Chemistry*, 29: 650

(1964), the disclosure of which is incorporated by reference. Amino-containing derivatives can be prepared by adapting the procedures described in *Canadian Journal of Chemistry,* 47:3677 (1969), the disclosure of which is incorporated herein by reference. Nitro-containing derivatives can be prepared by adapting the procedures described in *Journal of the American Chemical Society,* 73:2327 (1951), the disclosure of which is incorporated herein by reference. Other radical-containing derivatives such as those containing ammonium, hydroxylammonium, hydrazinium, guanidinium, aminoguanidinium, diaminoguanidinium, triaminoguanidinium or biguanidinium radicals, can be prepared by adapting the procedures detailed in Boyer, *Nitroazoles, Organic Nitro Chemistry* (1986), the disclosure of which is incorporated by reference.

An embodiment of the present invention relates specifically to preparing anhydrous gas generant compositions in the form of pellets. Anhydrous tetrazole compositions produce advantages over the hydrated forms. For example, a higher (more acceptable) burn rate is generally observed. At the same time, the methods of the present invention allow for pressing the composition in the anhydrous form such that pellets with good integrity are produced.

Following pellet formation, it may be preferable to protect the material from exposure to moisture or water, even though the material in this form may not be unduly hygroscopic at humidities below 20% Rh at room temperature. Thus, the pellet may be placed within a sealed container, or coated with a water impermeable material.

The burn rate performance of an anhydrous tetrazole-fueled gas generant composition is good. Burn rates above 0.5 inch per second (ips) are preferred. Ideally, burn rates are in the range of from about 1.0 ips to about 1.2 ips at 1,000 psi. Burn rates in these ranges can be achieved. The burn rates compare favorably with the burn rates observed for sodium azide compositions.

In general, pellets prepared by a preferred method are capable of exhibiting crush strengths in excess of 10 lb load in a typical configuration (⅜ inch diameter by 0.07 inches thick). This compares favorably to those obtained with commercial sodiumazide generant pellets of the same dimensions, which typically yield crush strengths of 5 lb to 15 lb load.

This is important because gas generants in pellet form are generally used for placement in gas generating devices, such as automobile supplemental restraint systems. Gas generant pellets should have sufficient crush strength to maintain their shape and configuration during normal use and withstand loads produced upon ignition since pellet failure results in uncontrollable internal ballistics.

The compositions are capable of generating large quantities of gas while overcoming various problems associated with conventional gas generating compositions. The compositions produce substantially nontoxic reaction products. The compositions are particularly useful for generating large quantities of a nontoxic gas, such as nitrogen gas. Significantly, the compositions also avoid the use of azides, produce no sodium hydroxide byproducts, and generate no sulfur compounds such as hydrogen sulfide and sulfur oxides.

The compositions also produce only limited particulate debris, provide good slag formation and substantially avoid, if not avoid, the formation of nonfilterable particulate debris. At the same time, the compositions achieve a relatively high burn rate, while producing a reasonably low temperature gas. Thus, the gas produced by the present invention is readily adaptable for use in deploying supplemental restraint systems, such as automobile air bags.

An inflatable restraining device, such as an automobile air bag system comprises a collapsed, inflatable air bag, a means for generating gas connected to that air bag for inflating the air bag wherein the gas generating means contains a nontoxic gas generating composition which comprises a fuel and an oxidizer therefor wherein the fuel comprises an anhydrous tetrazole or a salt or complex thereof, such as 5AT or BTA.

Suitable means for generating gas include gas generating devices which are used in supplemental safety restraint systems used in the automotive industry. The supplemental safety restraint system may, if desired, include conventional screen packs to remove particulates, if any, formed while the gas generant is combusted.

The present invention is further described in the following non-limiting example.

EXAMPLES

Example 1

A non-azide fuel, BTA monohydrate (274.8 grams) having a nominal particle size of approximately 100 microns, is blended in a muller mixer with an oxidizer, CuO (925.0 grams) having a nominal particle size of 6 microns, and water (30.0 grams) for about one hour to obtain a compactable powder. The compactable powder is blended in a Hobart mixer with water (400.0 grams) for about 15 minutes to obtain a paste. The paste is allowed to air dry at about 40° C. until it achieves a consistency suitable for agglomeration, such as by granulation, corresponding to about 20 to 25% by weight water. The partially dried paste is suitable for granulation, and is forced through a 16 mesh screen to produce small granules. The granules are then dried to constant weight at a temperature of about 31° C. An amount of the dried granules is removed and split into two portions of equal amounts. Both portions are further dried at about 120° C. for about 24 hours to remove remaining water. To one portion is added calcium stearate (0.20% by wt.). Pill-shaped pellets (⅜" diameter) are pressed from each of the further dried portions. The pellets are subjected to a Rh 45% treatment for 24 hours at 25° C., and the pellet condition is monitored. The pellets retain their pellet shape after 24 hours exposure to Rh 45%.

Comparative Example

A non-azide gas generating composition is prepared by blending 274.8 grams of the non-azide fuel, BTA monohydrate, having a nominal particle size of about 100 microns with 925.4 grams of copper oxide (CuO) having a nominal particle size of about 6 microns and 480 grams of water for about 90 minutes in a Hobart blender/mixer to obtain a past. The paste is dried at 40° C. to a consistency suitable for granulation. The mixture is then meshed through a 18-mesh screen to produce granules which were then allowed to dry in the air at ambient conditions. The granules are then pulverized for 30 minutes in a muller mixer to obtain a powder having an average particle size of substantially less than 100 microns.

A portion of the resultant powder is further dried at 120° C. for an additional 24 hours to achieve an anhydrous composition. The anhydrous powder is then pressed to produce ⅜-inch diameter pellets which are subsequently exposed to a Rh of 45% at 25° C. The pellets lose all integrity within four hours.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for preparing anhydrous gas generants comprising the steps of:

(a) preparing a mixture of oxidizer particles having a number average particle size of about 1 micron to about 20 microns and fuel particles having a number average particle size of about 1 micron to about 100 microns wherein the fuel is at least one fuel species selected from the group consisting of tetrazoles in a medium selected from the group consisting of alcohol, ketone, water, and mixtures thereof;

(b) agglomerating the mixture to obtain particles having a weight average particle size of about 100 mesh to about 14 mesh;

(c) drying the agglomerate to obtain anhydrous particles; and (d) shaping the anhydrous particles into a desired shape.

2. A method according to claim 1, wherein step (a) said medium is water, the mixture contains about 20% to about 50% by weight water, and the water has a pH of about 5 to about 11 before the mixture is prepared.

3. A method according to claim 2, wherein said tetrazole is selected from the group consisting of (i) 5-aminotetrazole, a salt thereof, or a complex thereof, (ii) bis-(1(2)H-tetrazol-5-yl)-amine, a salt thereof, or a complex thereof, and (iii) a mixture thereof.

4. A method according to claims 3, wherein the fuel is 5-aminotetrazole or bis-(1(2)H-tetrazol-5-yl)-amine.

5. A method according to claim 3, wherein said oxidizer is selected from the group consisting of metal oxides, metal hydroxides or a mixture thereof.

6. A method according to claim 5, wherein said oxidizer is an oxide or hydroxide of a metal selected from the group consisting of copper, molybdenum, bismuth, manganese, cobalt and iron.

7. A method according to claim 6, wherein said oxidizer is copper oxide or copper hydroxide.

8. A method according to claim 3, wherein said oxidizer is CuO.

9. A method according to claim 1, wherein said oxidizer is a metal oxide or a metal hydroxide which is a transition metal oxide or a transition metal hydroxide.

10. A method according to claim 9, wherein said oxidizer is copper oxide or copper hydroxide.

11. A method according to claim 9, further comprising the step of protecting the shaped anhydrous particles from exposure to water.

12. A method according to claim 1, wherein the medium is water, the mixture contains about 20% to about 50% by weight water, and the water has a pH of about 5 to about 11 before being combined with the fuel and/or oxidizer particles, and wherein step (c) the drying is conducted at a temperature below about 150° C. and the anhydrous particles have a weight average particle size of from about 14 mesh to about 30 mesh.

13. A method according to claim 12, wherein the fuel particles have a number average particle size in the range of about 10 microns to about 40 microns.

14. A method according to claim 13, wherein said oxidizer particles have a number average particle size greater than about 3 microns.

15. A method according to claim 12, wherein the tetrazole is selected from the group consisting of (i) 5-aminotetrazole, a salt thereof, or a complex thereof, (ii) bis-(1(2)H-tetrazol-5-yl)-amine, a salt thereof, or a complex thereof, and (iii) a mixture thereof.

16. A method according to claim 15, wherein the fuel particles have a number average particle size in the range of about 10 microns to about 40 microns, and the oxidizer particles have a number average particle size greater than about 3 microns.

17. A method according to claim 15, wherein the oxidizer is selected from the group consisting of metal oxides, metal hydroxides, and mixtures thereof.

18. A method according to claim 15, wherein said oxidizer is an oxide or hydroxide of a metal selected from the group consisting of copper, molybdenum, manganese, bismuth, cobalt and iron.

19. A method according to claim 15, wherein said oxidizer is an oxide or hydroxide of a metal selected from the group consisting of copper, molybdenum, bismuth, manganese, cobalt and iron.

20. A method according to claim 12, wherein said oxidizer is a metal oxide or a metal hydroxide which is a transition metal oxide or a transition metal hydroxide.

21. A method according to claim 12, wherein said oxidizer is an oxide or hydroxide of a metal selected from the group consisting of copper, molybdenum, bismuth, manganese, cobalt and iron.

22. A method according to claim 12, wherein step (a) the fuel is present in a fuel effective amount in the range of from about 10 to about 50 percent by weight, and said oxidizer is present in an effective oxidizing amount in the range of from about 90 percent to about 50 percent by weight.

23. A method according to claim 12, further comprising the step of protecting the shaped anhydrous particles from exposure to water.

24. A method according to claim 1, wherein the mixture in step (a) or step (b) includes a binder.

25. A method according to claim 1, wherein steps (b) and (c) are carried out concurrently.

26. A method for preparing anhydrous gas generants comprising the steps of:

(a) preparing a mixture of oxidizer particles having a number average particle size of about 1 micron to about 20 microns and fuel particles having a number average particle size of about 10 microns to about 40 microns wherein the oxidizer is selected from the group consisting of a metal peroxide, an inorganic nitrate, an inorganic nitrite, a metal oxide, a metal hydroxide, an inorganic chlorate, an inorganic perchlorate, or a mixture thereof, the fuel is at least one tetrazole selected from the group consisting of (i) 5-aminotetrazole, a salt thereof, or a complex thereof, (ii) bis-(1(2)H-tetrazol-5-yl)-amine, a salt thereof, or a complex thereof, and (iii) a mixture thereof in at least about 20% by weight and up to about 40% by weight water;

(b) granulating the mixture to obtain granules having a weight average particle size of about 100 mesh to about 14 mesh;

(c) drying the granules to obtain anhydrous granules; and (d) pelletizing the anhydrous granules into pellets.

27. A method according to claim 26, further comprising the step of protecting the shaped anhydrous particles from exposure to water.

28. A method according to claim 26, wherein a binder is added during any one of steps (a), (b), or (c).

29. A method according to claim 26, wherein a mold release agent is added at step (c).

* * * * *